US011199001B2

(12) United States Patent
Vogler et al.

(10) Patent No.: US 11,199,001 B2
(45) Date of Patent: Dec. 14, 2021

(54) PLASTIC WALL PANEL WITH EDGE REINFORCEMENT

(71) Applicant: Suncast Technologies, LLC, Palm Beach Gardens, FL (US)

(72) Inventors: Michael R. Vogler, Oswego, IL (US); Justin Reyburn, Batavia, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 0 days.

(21) Appl. No.: 15/814,985

(22) Filed: Nov. 16, 2017

(65) Prior Publication Data

US 2018/0142459 A1 May 24, 2018

Related U.S. Application Data

(60) Provisional application No. 62/425,452, filed on Nov. 22, 2016.

(51) Int. Cl.

| | |
|---|---|
| ***E04B 1/24*** | (2006.01) |
| ***E04H 1/12*** | (2006.01) |
| ***E04B 1/348*** | (2006.01) |
| ***E04B 1/343*** | (2006.01) |
| ***E04B 1/61*** | (2006.01) |

(52) U.S. Cl.

CPC ..... *E04B 1/2403* (2013.01); *E04B 1/34315* (2013.01); *E04B 1/34321* (2013.01); *E04B 1/34846* (2013.01); *E04B 1/6141* (2013.01); *E04H 1/1205* (2013.01); *E04B 2001/2415* (2013.01)

(58) Field of Classification Search

CPC ..... E04H 1/1205; E04H 1/005; E04B 1/2403; E04B 1/34321; E04B 1/6141; E04B 1/34315; E04B 1/34846; E04B 2001/2415; E04B 1/343; E04B 1/34384; E04B 1/6104; E04B 1/6125; E04B 1/6137

USPC ..... 52/97.1, 79.5, 96.6, 79.9, 270, 271, 284; 446/108

See application file for complete search history.

(56) References Cited

U.S. PATENT DOCUMENTS

| | | | | | |
|---|---|---|---|---|---|
| 2,142,305 | A * | 1/1939 | Davis | E04B 1/6125 | 52/592.1 |
| 3,271,919 | A * | 9/1966 | Olton | E06B 3/88 | 52/717.01 |
| 3,313,073 | A * | 4/1967 | Mathews | E04B 1/76 | 52/309.11 |
| 3,531,855 | A * | 10/1970 | Spring, Jr. | B21D 49/00 | 108/57.23 |
| 3,998,679 | A * | 12/1976 | Gwynne | B28B 11/04 | 156/42 |
| 4,242,848 | A * | 1/1981 | Schoultz | A47B 95/043 | 108/27 |
| 4,649,682 | A * | 3/1987 | Barrett, Jr. | E04C 2/384 | 174/480 |

(Continued)

*Primary Examiner* — Christine T Cajilig
(74) *Attorney, Agent, or Firm* — McHale & Slavin, P.A.

(57) ABSTRACT

The present invention relates to a modular building structure that can be used for storage in a yard or the like. It comprises a plurality of sidewall panels and roofing panels. At least some of the sidewall panels have a pair of opposing marginal edges with adjacent marginal edges being provided with flanges that can overlap one another. At least one of the marginal edges has a reinforcing channel secured to a bead portion thereof and extending along a substantial portion of the length of the bead edge.

10 Claims, 6 Drawing Sheets

(56) References Cited

U.S. PATENT DOCUMENTS 5,129,628 A * 7/1992 Vesper ..... E04H 17/16 256/31
5,373,678 A * 12/1994 Hesser ..... E04C 2/292 52/309.2
5,524,400 A * 6/1996 Schmechel ..... E04B 1/14 52/236.7
5,625,999 A * 5/1997 Buzza ..... E04C 2/296 52/309.11
5,638,651 A * 6/1997 Ford ..... E04C 2/246 52/265
5,722,198 A * 3/1998 Bader ..... E04B 1/14 52/309.4
5,799,462 A * 9/1998 McKinney ..... B29C 33/40 29/897.32
6,044,603 A * 4/2000 Bader ..... E04C 2/384 52/309.16
6,564,521 B1 * 5/2003 Brown ..... E04C 2/292 52/309.11
6,581,337 B1 6/2003 Skov et al.
6,701,678 B1 3/2004 Skov et al.
7,162,847 B2 * 1/2007 Gigiakos ..... E04B 2/7453 52/582.1
7,654,060 B2 2/2010 Steed et al.
7,836,663 B2 * 11/2010 Solomon ..... E04C 2/384 52/782.1
7,886,501 B2 * 2/2011 Bartlett ..... E06B 3/88 52/717.01
8,132,372 B2 * 3/2012 Mower ..... E04B 1/12 52/270
8,161,699 B2 * 4/2012 LeBlang ..... E04B 1/165 52/252
8,161,711 B2 4/2012 Steed et al.
8,176,696 B2 * 5/2012 LeBlang ..... E04B 1/165 52/252
8,327,593 B2 * 12/2012 Laprise ..... E04B 1/14 52/284
8,756,889 B2 * 6/2014 LeBlang ..... E04B 1/80 52/252
8,800,227 B2 * 8/2014 LeBlang ..... E04B 1/165 52/309.11
10,024,057 B2 * 7/2018 Gibson ..... E04C 2/284
10,240,334 B2 * 3/2019 Paulus ..... E04B 1/08
2005/0055972 A1 * 3/2005 Luty ..... E04B 1/6141 52/741.1
2005/0204699 A1 * 9/2005 Rue ..... E04C 2/22 52/794.1
2005/0210766 A1 * 9/2005 Mower ..... E04B 1/34321 52/79.5
2007/0175108 A1 8/2007 Stein et al.
2008/0196355 A1 * 8/2008 Williams ..... E04B 1/14 52/794.1
2012/0102847 A1 * 5/2012 Kopp ..... E04H 1/1205 52/79.1
2012/0110926 A1 * 5/2012 Phillips ..... E04H 1/1205 52/79.9
2012/0227349 A1 * 9/2012 Phillips ..... E04H 1/1205 52/588.1
2013/0000218 A1 * 1/2013 Uffner ..... E04B 1/34321 52/79.1
2013/0178299 A1 * 7/2013 Kopp ..... A63G 9/00 472/136
2014/0105686 A1 * 4/2014 Southworth ..... E02B 7/02 405/107
2014/0182220 A1 * 7/2014 Hunt ..... E04B 7/20 52/79.9
2014/0283464 A1 * 9/2014 Vogler ..... E04B 1/34321 52/79.5
2015/0089891 A1 * 4/2015 Schiffmann ..... E02D 27/013 52/309.1

* cited by examiner

PLASTIC WALL PANEL WITH EDGE REINFORCEMENT

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/425,452, entitled "PLASTIC WALL PANEL WITH EDGE REINFORCEMENT", filed Nov. 22, 2016. The contents of the above referenced application are incorporated herein by reference in its entirety.

FIELD OF THE INVENTION

The present invention relates to a modular building structure that can be used for storage in a yard or the like, and more particularly to a plastic wall panel with edge reinforcement.

BACKGROUND OF THE INVENTION

Modular storage buildings are well known in the art. Typically, they are made with interconnectable panels that can be easily packaged to reduce shipping bulk. The panels will generally include wall panels, roof panels and floor panels. The consumer will unpackage the panels in the kit and assemble them to form the building. These buildings are commonly used for yard storage and are available in different sizes with different features. The assembled buildings are used to provide storage space that is weather resistant.

To be desirable to consumers and provide value, the finished building should be sturdy to resist damage from use, and should be resistant to wind and precipitation. To provide an affordable structure, the structure needs to be lightweight to reduce material cost. The components should also be easy to manufacture by known construction methods that are low cost and that reduce manufacturing labor usage. Assembly is done by the consumer thus, the structure should be easy to assemble and not require heavy component parts or difficult to use or specialty tools for assembly.

One particularly effective method of making the panels is by molding thermoplastic material such as high density polyethylene (HDPE). HDPE is a less expensive material and durable against both weather and ultraviolet degradation. Blow molding can be used to produce large hollow waterproof panels, as large as four feet by eight feet. Such molding is also effective at forming complex shapes and contours in one step. Other methods of molding are also known, such as rotational molding, injection molding, thermoforming and the like. Blow molding and rotational molding are desirable because they can be used to form integral hollow panels with thin walls. Molded sheets, such as thermoformed sheets, can be joined together at marginal edges, as by heat welding, to also form a hollow panel.

Suitable thermoplastics include, but should not be limited to, polyethylene, both low and high density, polypropylene, acrylonitrile butadiene styrene (ABS), vinyl, PVC and foams. The plastic material may also have reinforcing filler such as fiberglass or carbon fiber.

A problem with current panels is that, to keep cost low, the walls and edges are thin, thus reducing their strength, particularly in bending at their vertically oriented edges, which can be long, as much as eight feet. Deflection of a beam along its length under load is proportional to the cube of its length. Therefore, a small increase in length can result in a significant increase in the amount of bending under a given load. However, given current molding techniques, adding more plastic at the edges is difficult, particularly in view of the desire to have panels that include generally planar main surfaces. This is a particular problem when adjacent panels use a lap joint, which inherently thins the edge at a joint and hence reduces its resistance to bending proportional to the cube of its thickness. Therefore, a reduction in thickness by half results in an eight fold increase in bending.

There is thus a need for an improved wall panel for use in modular building structures.

DESCRIPTION OF THE PRIOR ART

U.S. Pat. No. 6,581,337 discloses a modular enclosure that utilizes wall panels that are in the form of the channel having a main panel portion with two flanges projecting at right angles from the main panel. The flanges are used to connect adjacent panels together with fasteners extending through aligned holes. The wall panels are not hollow structures and do not utilize lap joints between adjacent panels.

U.S. Pat. No. 6,701,678 discloses a modular enclosure that utilizes wall panels that connect at marginal edges through the use of a double tongue and groove arrangement. Complex connectors 128 are then used to join two adjacent panels together, maintaining the double tongue and groove arrangement interengaged.

U.S. Pat. Nos. 7,654,020 and 8,161,711 disclose free-standing partitions apparently for use indoors. Reinforcing members can be installed in a partition within an elongate hollow passage extending between top and bottom portions of the panel. Two or more partitions can be joined together at the edges. Joining panels together is accomplished by connectors positioned at the top and bottom of the panels adjacent marginal edge portions.

SUMMARY OF THE INVENTION

The invention involves the provision of a wall panel for a modular building structure usable for storage. The structure utilizes a plurality of panels joined together at marginal side edge lap joints. At least one of the panels include an edge bead configured to have a reinforcing channel mounted thereon and extending at least a substantial portion of the length of the panel.

Accordingly, it is a primary objective of the instant invention to provide a panel with a bead that will securely hold a channel in place and not interfere with a side margin lap joint.

It is a further objective of the instant invention to provide a channel that can be easily mounted on a panel after the panel is formed.

It is yet another objective of the instant invention to provide a channel that can be permanently mounted to a panel.

It is a still further objective of the invention to provide a panel construction that allows adjacent panels to be easily connected together with mechanical fasteners.

It is a still further objective of the invention to provide a panel construction that provides a weather resistant joint between adjacent panels.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
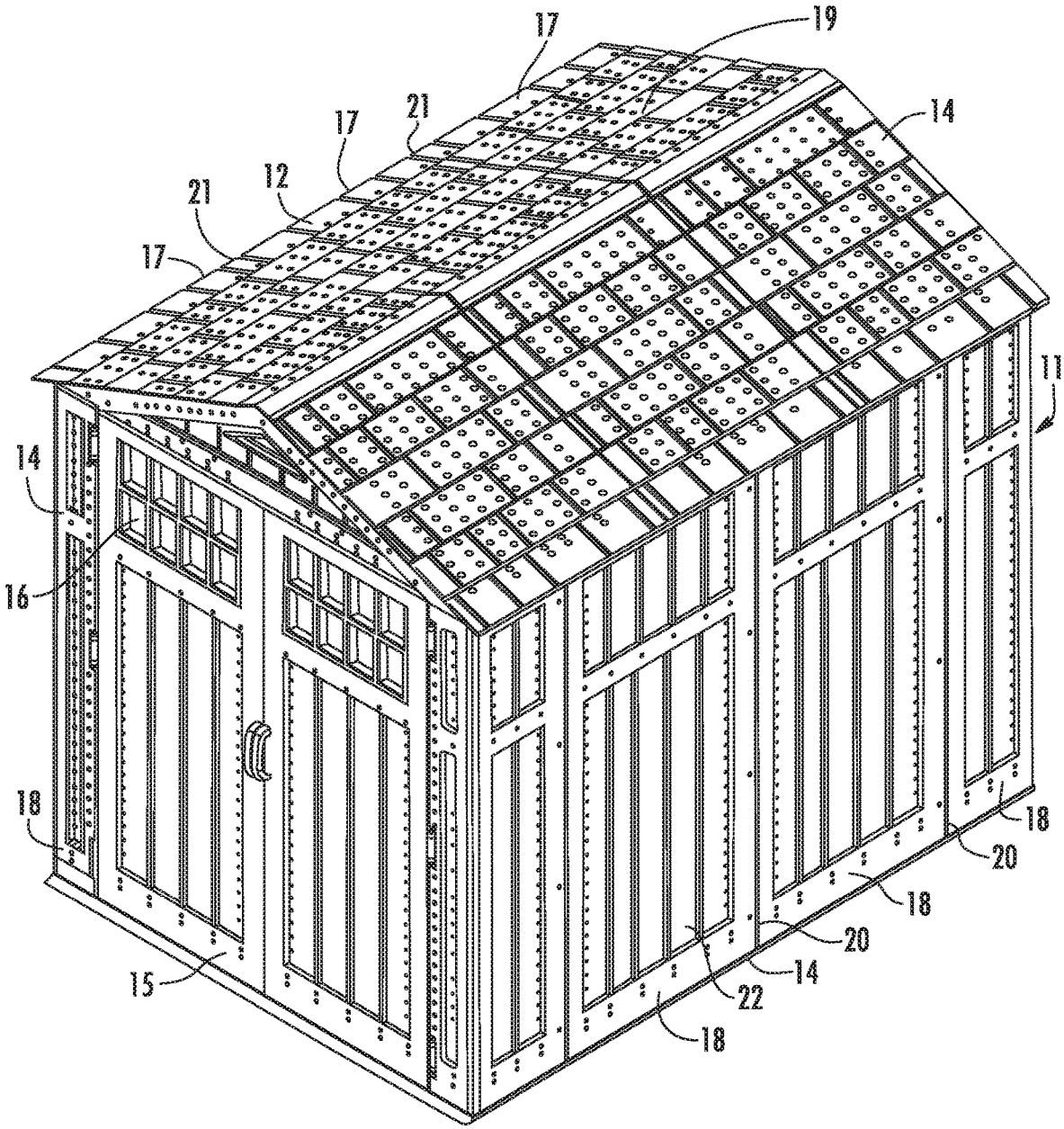
FIG. 1 is a perspective view of a modular building with portions broken away to show structural details.

The reference numeral 11 designates generally a modular building for use for yard storage. Such buildings are well known in the art. Representative buildings can be found in U.S. Pat. Nos. 9,032,670 and 9,151,068 assigned to the assignee of the present application. The general construction details disclosed in these two patents are fully incorporated herein by reference except as noted herein. Such buildings 11 include a roof 12, sidewalls 14 and a floor (not shown). Such buildings 11 may also include a hinged door 15 and a window 16. A window 16 can be in a door 15 or a sidewall 14. As shown in these two referenced patents, the buildings are made from interconnected panels such as roof panels 17, wall panels 18 and floor panels (not shown herein, but are shown in the referenced patents). The panels 17 and 18 are typically made by a molding process such as blow molding with hollow interiors and are made of a polymeric material as described above in the Background. The panels 17, 18 are preferably made of thermoplastic materials such as those listed in the Background above. Other molding methods, such as rotational molding, can be used, or separate sheets can be joined together at their peripheral edges, such as by heat sealing. The panels 17 and 18 are preferably hollow to reduce the use of material and to make the component parts lightweight. Adjacent panels 17 and adjacent panels 18 are suitably coupled together to form ceiling and sidewall structures. The panels 17, 18 have main panel portions 19, 22 respectively.

Figure 2:
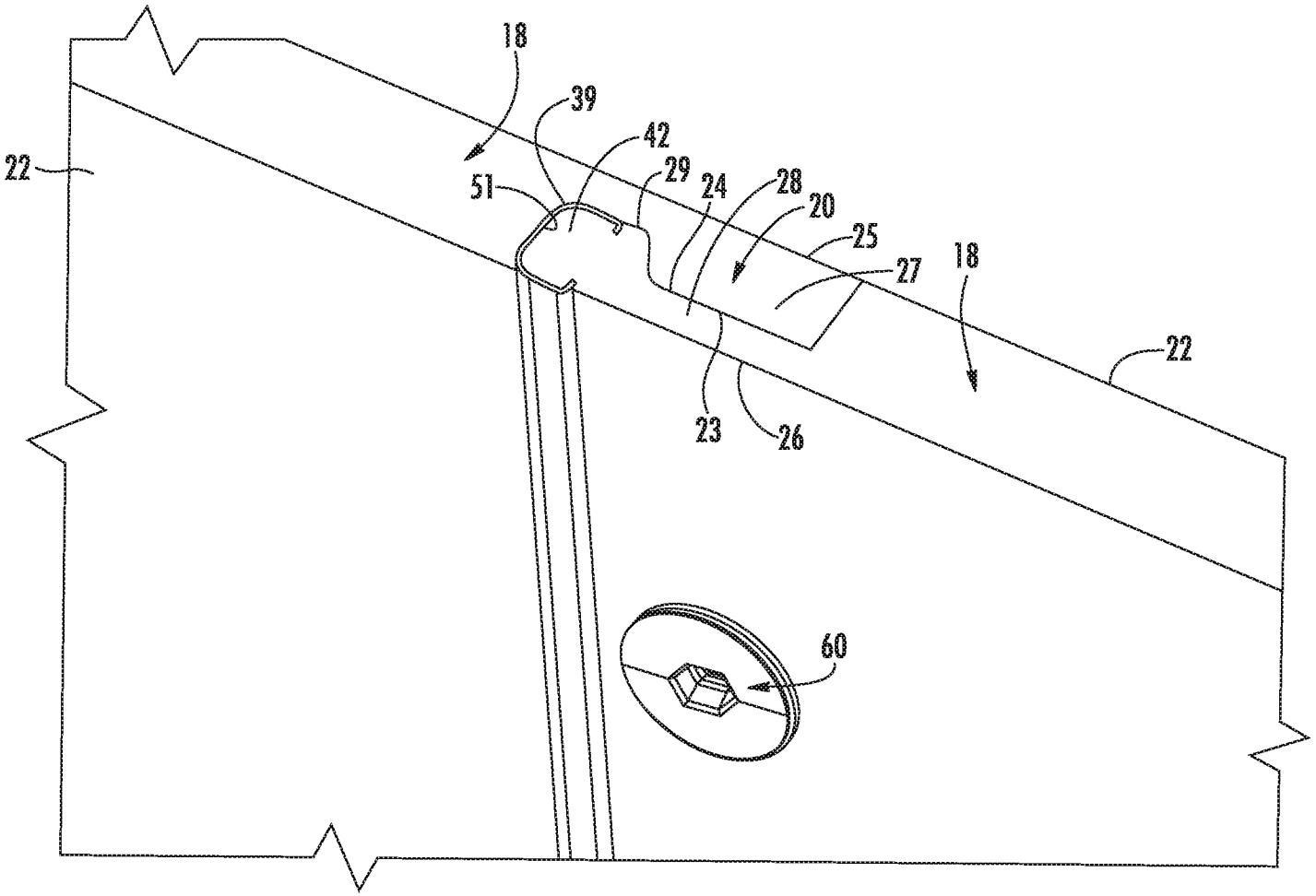
FIG. 2 is an enlarged fragmentary perspective view of two panels at a first form of lap joint.
Figure 3:
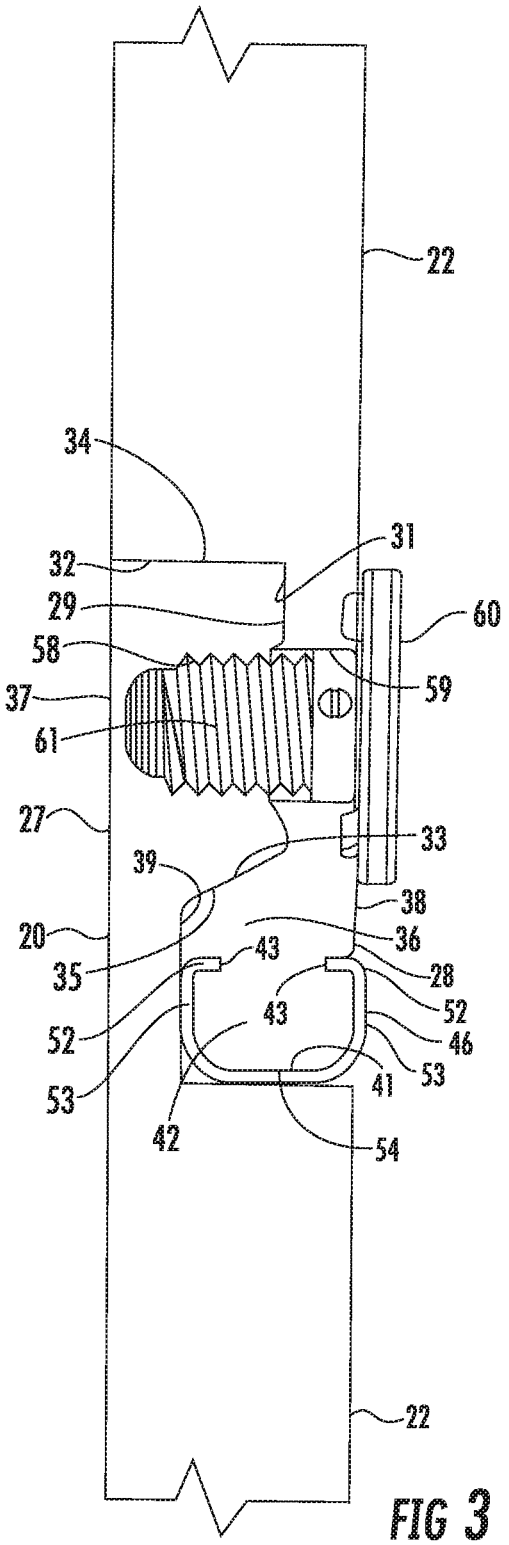
FIG. 3 is a cross sectional view of the lap joint of FIG. 2.

The present invention will be described with a joint 20 between two adjacent sidewall panels 18. However, it is to be understood that the invention can be used at a joint 21 between two adjacent ceiling panels 17 if desired. A representative joint 20 is shown in FIGS. 2-3. Position descriptions like side, top and bottom used herein are used as if the panel or part is used in the assembled building 11 construction.

FIG. 2 illustrates a first embodiment of two interconnected panels 18. The panels 18 are joined together at joint 20. In this embodiment, the joint 20 is a lap joint that has overlapping mechanically interlocking flanges 27 and 28. The flanges 27, 28 have interior surfaces 23, 24 and exterior surfaces 25, 26 respectively. The flanges 27, 28 have thickness less than the main panel portions 22. The flange 27 has a tongue 29 that has a transverse cross-sectional shape that is received in a groove 31 in the flange 28 and captured between two generally opposing end surfaces 32, 33 of the groove 31. The tongue 29 has generally opposing side edge surfaces 34, 35 that correspond in shape and orientation to the surfaces 32, 33. The flange 28 has a tongue 36 received within a groove 39 in the flange 27. This double tongue and groove arrangement forms a mechanical interlock to help resist relative lateral movement between adjacent panels 18. It also provides a tortuous path for water and wind to traverse before it can pass through the joint 20. The tongues 29, 36 extend along the length of adjacent panels 18. Likewise, the grooves 31, 39 also extend along the length of their respective panels 18. On a given panel 18, preferably its flange 27 has a tongue 29 while its flange 28 on the opposite side edge has a groove 31.

Figure 6:
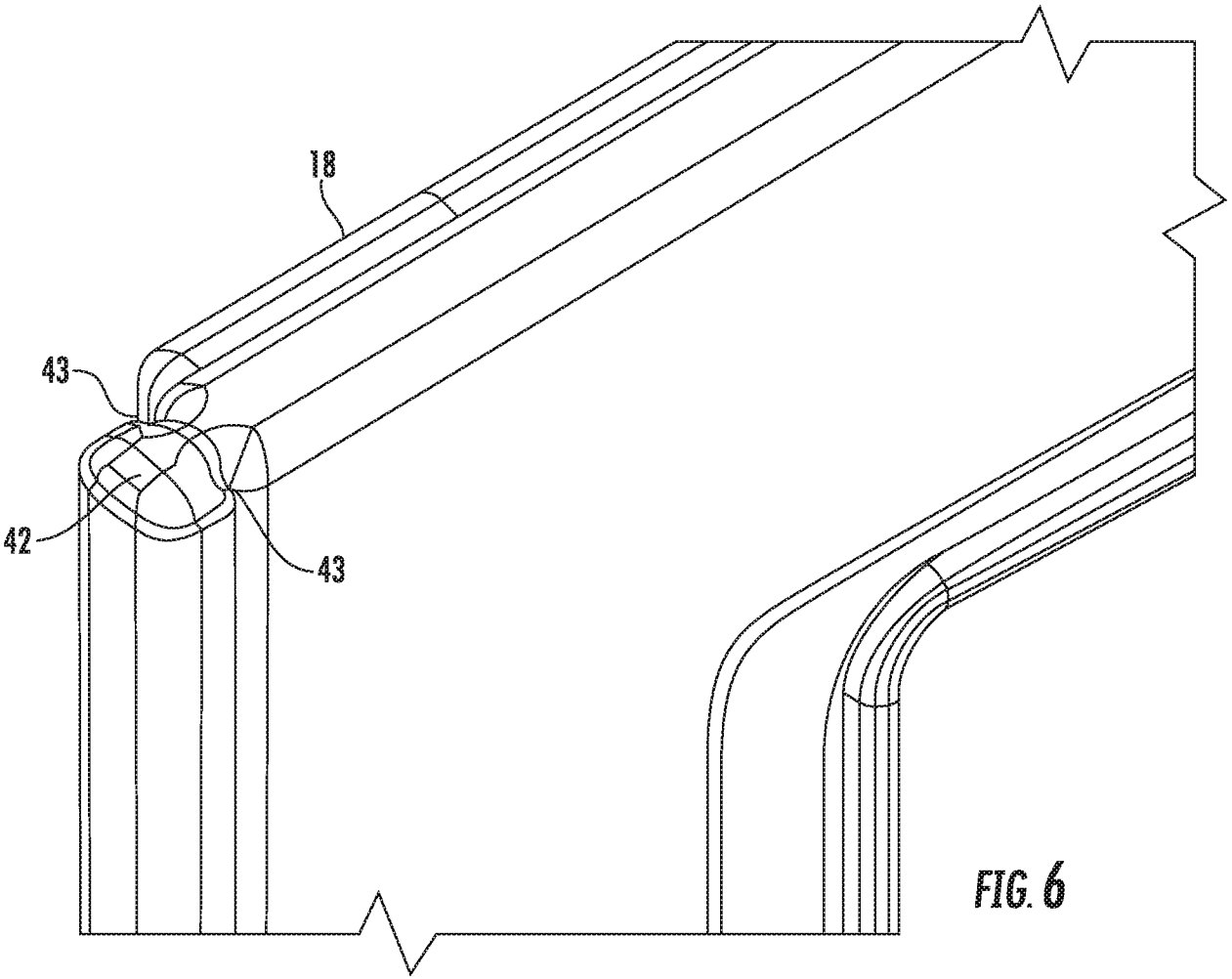
FIG. 6 is an enlarged fragmentary perspective view of a marginal edge portion of a panel showing details of a bead.

As illustrated, means is provided at the exterior side edge 41 of a panel 18 to secure a reinforcing channel member 46 to a panel 18. It is to be understood that both side edges 41, 34 of a panel 18 could be provided with a reinforcing channel 46 or the channel can be secured to the panel 18 on the interior side edge 34. Preferably, at least part of the securement of the channel 46 is by mechanical interlocking between portions of the channel 46 and portions of a panel 18. As shown, the panel edge portion 41 having the groove 31 includes an edge bead 42 extending along its length. The bead 42 fits in the channel 39 of the flange 27. In the illustrated structure, the bead 42 includes a pair of outwardly opening and lengthwise extending channel grooves 43 with one groove on each side of the flange 28. A portion of the bead 42 extends laterally sideways away from the groove 43 (FIG. 6) and forms part of the side edge 41 of the flange 28. The bead 42 and grooves 43 preferable extend the full length of the panel 18, and the bead has a uniform exterior cross sectional shape along its length.

The channel member 46 has an interior surface 51 that corresponds in size and shape to the exterior surface of the bead 42, FIG. 2. It is sized and shaped to be received over the outer portion of the bead 42 and has inwardly projecting longitudinally extending ribs 52, each of which are sized and shaped to be received in a respective channel groove 43. The channel member 46 is preferably continuous and has a length substantially equal to the length of a panel 18 extending between the top and bottom thereof. In its lateral cross-section, the channel member 46 has a pair of legs 53, with the leg 53 inside the joint 20 being an inside leg and the leg 53 on the outside of the joint 20 being an outside leg, each extending from a respective rib 52. A bight portion 54 is connected to and extends between the legs 53. Preferably, the outer surfaces of the legs 53 are flush to below flush with the adjacent surfaces of the flange 28 or the flange 27 if it has a channel member 46 mounted thereon. It is to be understood, however, that at least the outer surface of the inside leg 53 be flush or below flush. The channel member 46 can be held in place by frictional engagement between its interior surface and the exterior surface of the bead 42. A channel member 46 may be mounted on a respective bead 42 by sliding it longitudinally along the bead 42, or may be resiliently deformed and snapped over the bead until both ribs 52 are each in a respective groove 43. The channel 46 can also be suitably secured to the bead 42 with an adhesive if desired. The securement resists longitudinal movement of the channel member 46 relative to the panel 18 after it is installed. The channel member 46 can be roll formed, stamped or extruded if made of metal or metal alloy, herein referred to as metal. Suitable metals include aluminum, steel and the like. The wall thickness of the channel 46 can be on the order of 0.01 inches to about 0.06 inches. The outer surface of a channel member 46 is shaped similarly to the inner surface of the channel 46 to facilitate its formation.

The channel member 46 can also be a molded plastic material or plastic with reinforcing filler. The channel member 46 can be a composite of metal and molded plastic if desired. A preferred material for the channel 46 is an aluminum alloy or galvanized or painted steel to provide resistance to corrosion.

Adjacent panels 18 are secured together, preferably with mechanical fasteners. The flanges 27 and 28 are placed in overlying relationship to one another with the top edges and bottom edges of two adjacent panels being preferably aligned. During the formation of the panel 18 and hence the flange 27, as seen in FIG. 3, a plurality of threaded bores 58 are formed therein. Through openings 59 are provided in the flange 28 to receive a shank 61 of a fastener 60 therethrough. A preferred fastener 60 is commonly referred to as an easy bolt. The shank 61 has external threads that are received in internal threads within the bores 58 and, upon tightening of the fasteners 60, the flanges 27, 28 are brought together, securing two adjacent panels 18 with the flanges 27, 28 being in overlapping relationship. Preferably, a plurality of fasteners 60 are provided in spaced apart relationship along the length of the panel 18 to effect the joinder of adjacent panels 18.

Figure 4:
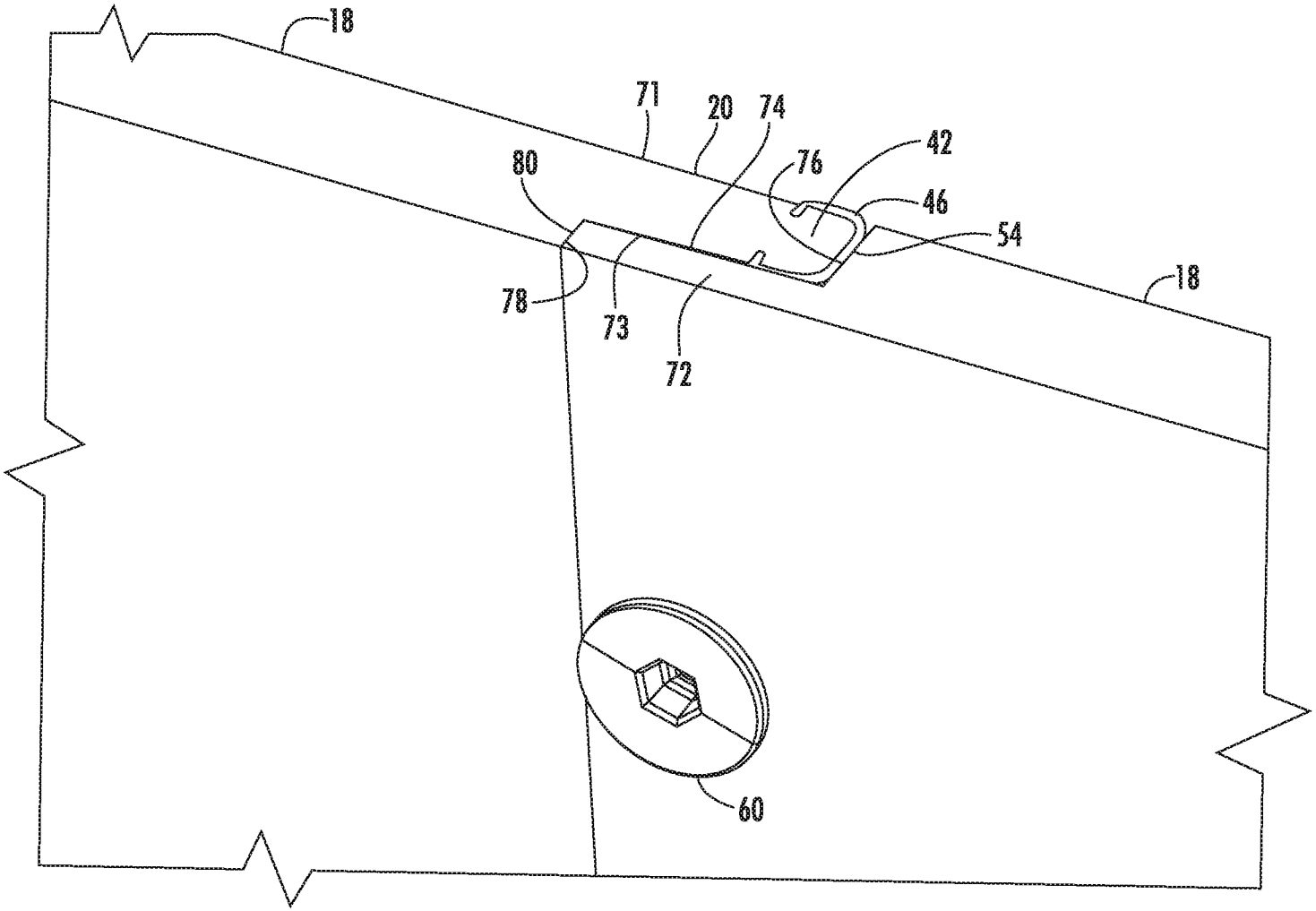
FIG. 4 is an enlarged fragmentary perspective view of two panels at a second form of lap joint.
Figure 5:
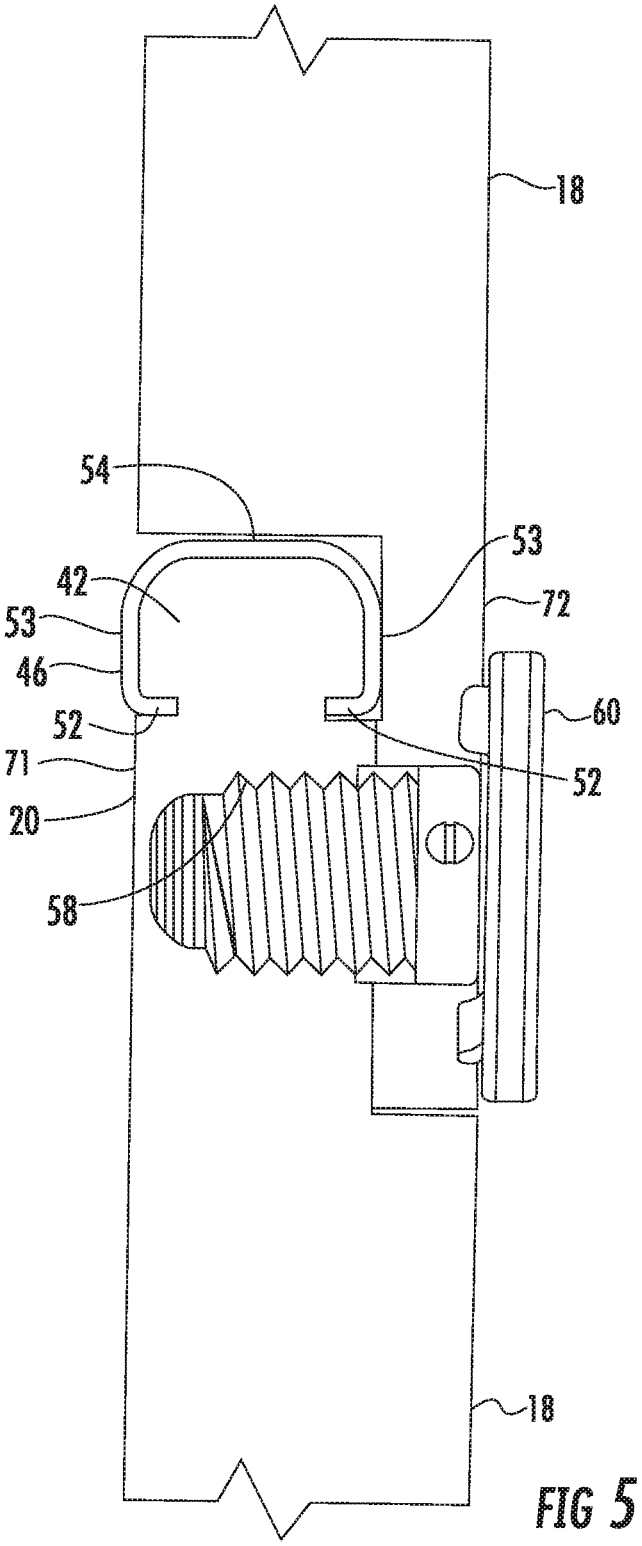
FIG. 5 is a cross sectional view of the lap joint of FIG. 4.

FIGS. 4, 5 show a second form of overlapping marginal flanges forming a lap joint. These flanges are designated generally 71, 72. The flanges 71, 72 do not use the double tongue and groove arrangement of the flanges 27, 28. Instead, they have generally planar abutting overlapping surfaces 73, 74 respectively. The bight 54 abuts a longitudinal side edge surface 76 and the side edge surface 78 of flange 71 abuts the side edge surface 80 of flange 72. The remainder of the structure of a panel 18, channel member 46 and bead 42 are the same or similar as described above.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A multiple panel construction for use in a modular building, said panel construction including:

a first hollow polymeric panel having a first flange along a first marginal side edge of a first main panel portion and extending along at least a substantial portion of said first marginal side edge, said first flange having thickness less than said first main panel portion and having an inside surface and an outside surface;

a second hollow polymeric panel having a second flange along a second marginal side edge of a second main panel portion and extending along at least a substantial portion of said second marginal side edge, said second flange having thickness less than said second main panel portion and having an inside surface and an outside surface, said second flange overlying said first flange, forming a lap joint between the first and second panels;

at least one of said first and second flanges having an edge bead extending along the length thereof and being partially defined by a respective said inside and outside surface;

a reinforcing channel member secured to said at least one bead and forming an end edge for the respective said first or second flange, said channel member having an outside leg and an inside leg connected by a bight portion forming a channel, said channel having an interior surface that corresponds in size and shape to an exterior surface of said bead with the bead being positioned between the legs and bight, said channel member being at least partially formed of metal, said reinforcing channel positioned on said edge bead after formation of a respective first or second hollow polymeric panel and held in position by friction before assembly to an adjacently positioned panel; and said first and said second flanges having sufficient length so that at least one mechanical fastener extends through the first flange and the second flange adjacent said channel member, forming a lap joint between the first and second panels, each said reinforcing channel member providing support to a respective said second hollow polymeric panel.

2. The panel construction of claim 1 wherein an outer surface of the inside leg being flush to below flush with the inside surface of the flange with the bead.

3. The panel construction of claim 1 wherein the first and second panels are part of a sidewall of a modular building usable for yard storage.

4. The panel construction of claim 1 wherein the first and second panels are part of a roof of a modular building usable for yard storage.

5. The panel construction of claim 1 wherein the bead including a first groove extending along the length of the respective said flange and recessed in the inside surface and a second groove extending along the length of the respective said flange and recessed in the outside surface, said channel having a first rib extending along the length of a first said leg and a second rib extending along the length of a second said leg, said first rib being positioned in the first said groove and said second rib being positioned in the second said groove.

6. The panel construction of claim 1 wherein the first and second panels being secured together with a plurality of said at least one mechanical fastener.

7. The panel construction of claim 6 wherein the first and second panels are part of a sidewall of a modular building usable for yard storage.

8. The panel construction of claim 5 wherein said first flange having a first tongue adjacent a first free edge and a first groove between the first tongue and the first main panel portion, said second flange having a second tongue adjacent a second free edge and a second groove between the second tongue and the second main panel portion and wherein the first tongue is positioned in the second groove and the second tongue is positioned in the first groove.

9. The panel construction of claim 1 wherein the reinforcing channel is positioned on the edge bead after formation of a respective first or second hollow polymeric panel by sliding the reinforcing channel longitudinally over the bead.

10. The panel construction of claim 1 wherein the reinforcing channel is positioned on the edge bead after formation of a respective first or second hollow polymeric panel by flexing the reinforcing channel longitudinally to slip over the bead, the reinforcing panel returning to its original shape after installation over the bead to grip the bead.

* * * * *